United States Patent [19]

Breslow et al.

[11] 4,219,195

[45] Aug. 26, 1980

[54] MANUAL MANIPULATION GAME

[75] Inventors: Jeffery D. Breslow, Highland Park; Eugene Jaworski, Park Ridge, both of Ill.

[73] Assignee: Marvin Glass & Associates, Chicago, Ill.

[21] Appl. No.: 974,349

[22] Filed: Dec. 29, 1978

[51] Int. Cl.[3] ..... A63F 7/02; A63F 7/24

[52] U.S. Cl. ..... 273/110; 273/DIG. 26

[58] Field of Search ..... 273/110, 111, 113, 108, 273/109, 120 R, 119 R, 86 H, 104, 105.2

[56] References Cited

U.S. PATENT DOCUMENTS

| | | | |
|---|---|---|---|
| 659,352 | 10/1900 | Park | 273/104 |
| 927,106 | 7/1909 | Bristow | 273/120 R |
| 3,643,952 | 2/1972 | Sprowl | 273/110 |
| 4,055,344 | 10/1977 | Soucie | 273/110 |

*Primary Examiner*—Richard C. Pinkham

*Assistant Examiner*—Scott L. Brown

*Attorney, Agent, or Firm*—Mason, Kolehmainen, Rathburn & Wyss

[57] ABSTRACT

A manual manipulation toy includes a circular platform having a plurality of upstanding spaced apart pins thereon adapted to engage and interrupt the progress of a rolling ball which is released at an upper level on the surface of the platform to roll towards a lower level while the platform is manually rotated in either direction to move the pins into engagement with the rolling ball thereby to retain the ball on the surface as long as possible. The platform is supported for rotation about an inclined, upstanding central axis and means is provided for selectively adjusting the angle of inclination and for counting the number of revolutions of the platform between the time when the ball is first released and subsequently rolls off an edge of the surface into a peripheral trough.

11 Claims, 4 Drawing Figures

MANUAL MANIPULATION GAME

BACKGROUND OF THE INVENTION

1. Field of the Invention

The present invention relates to a manual manipulation toy which is fun to play with and which is useful in improving the manual dexterity and concentration of the players.

2. Brief Description of the Prior Art

A wide variety of toys are available utilizing the manual dexterity and skill of a player as a paramount ingredient in solving or completing a problem or task presented by the toy. Manual manipulation type toys are easily understood by players of diverse age groups and require both mental concentration and manual skills while at the same time, providing stimulation and a competitive relation between players. Several manually manipulated toys employ a rolling ball or projectile movable along a path or play area which is manipulated to move by a player to achieve a given result. One such toy is shown and described in U.S. Pat. No. 600,696 which discloses a puzzle device having a pair of relatively rotatable disks forming a plurality of concentric tracks or raceways for a ball, with interconnecting passages between the concentric tracks or runs. Another toy or game is disclosed in U.S. Pat. No. 3,399,894 which employs a ball rollable on a plurality of spaced apart, stacked platforms or surfaces mounted within a transparent spherical container. Another manual manipulation toy is shown and described in U.S. Pat. No. 3,612,533 wherein a ball or projectile is movable between a pair of disks which are interconnected by a plurality of spaced apart pin-like ribs which are movable upon rotation of the disks to intercept and engage a ball which is released from a pocket for movement downwardly between the disks through the maze of pin-like ribs, with an object being to capture the ball in a hollow sleeve at the center of the disks before the ball drops completely out of the confined space between the disks.

OBJECTS OF THE INVENTION

It is an object of the invention to provide a new and improved manipulation toy and more particularly a manual manipulation toy of the type wherein both mental concentration and mental dexterity or skill are required.

Yet another object of the present invention is to provide a toy of the character described which is interesting to play with, and which is readily understood and useable by players of diverse age groups.

Still another object of the present invention is to provide a toy of the character described which is relatively simple in structure so that production can be accomplished on a mass production basis with the attendant economies of scale thus making the toy readily available to a wide range of the population.

Still another object of the present invention is to provide a toy of the character described which can be utilized in a competitive game between several players.

Yet another object of the present invention is to provide a toy of the character described which is useful in improving the execution and control of manual activity and hand-eye coordination.

SUMMARY OF THE INVENTION

The foregoing and other objects and advantages of the present invention are accomplished in an illustrative embodiment comprising a manual manipulation toy having a platform with an inclined upper surface for supporting a rolling ball which is released at an upper level on the surface for rolling movement toward a lower level. A support is provided to mount the platform for manual rotation about an inclined central axis extending upwardly thereof and a plurality of upstanding, spaced apart, pins are mounted on the platform to form a movable maze around the axis which the rolling ball passes through. Upon manual rotation of the platform, the pins are adapted to engage the rolling ball which is released at the upper level and this engagement is controlled to impede the downward rolling progress of the ball for as long as possible. A counter is provided for recording the number of revolutions of the platform between the time when the ball is initially released at the upper level and when the ball finally rolls off the surface of the platform into a peripheral trough around the platform. It is an object of the game to obtain a maximum number of platform revolutions before the ball rolls off the platform into the collecting trough and in accomplishing this object, the platform is manually rotated in either direction when the ball is released. The support structure is selectively adjustable to provide several different angles of platform inclination to make longer retention of the ball on the platform after release either more or less difficult as desired.

BRIEF DESCRIPTION OF THE DRAWINGS

For a better understanding of the present invention, reference should be had to the following detailed description taken in conjunction with the drawings, in which.

DESCRIPTION OF THE PREFERRED EMBODIMENT

Figure 1:
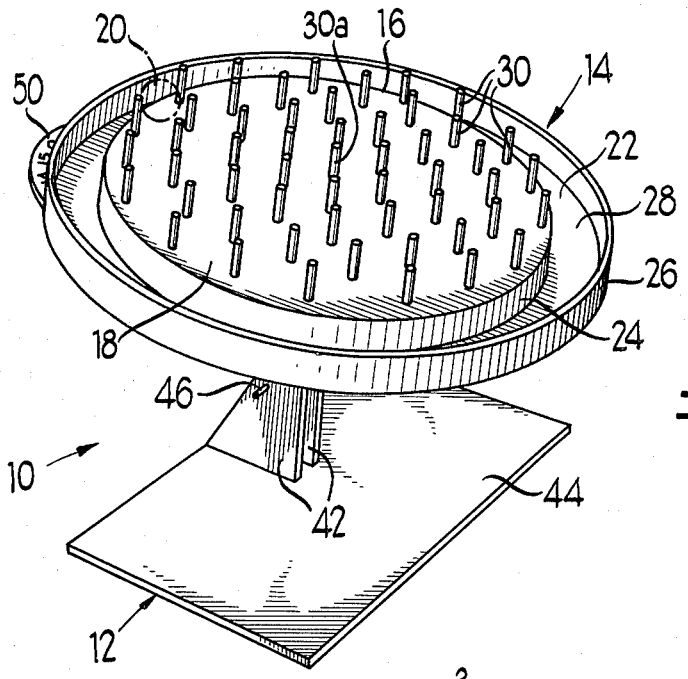
FIG. 1 is a perspective view of a new and improved manual manipulation toy constructed in accordance with the features of the present invention and illustrated in a position ready for play.

Referring now more particularly to the drawings, therein is illustrated a new and improved manual manipulation toy constructed in accordance with the features of the present invention and referred to generally by the reference numeral 10. The toy includes a base structure 12 adapted to rest on a floor or other playing surface and the base structure supports a generally cylindrical shaped body 14 for manual rotation about an upstanding, adjustable inclined axis, represented by the line A—A in FIG. 3.

The body structure 14 includes a centrally disposed, circular platform 16 having a planar upper surface 18 which provides an inclined supporting surface for a spherical ball 20 which is first placed at an upper level on the surface and released to roll downwardly toward a lower level as the body 14 is manually rotated in either direction around the inclined axis A—A.

Figure 3:
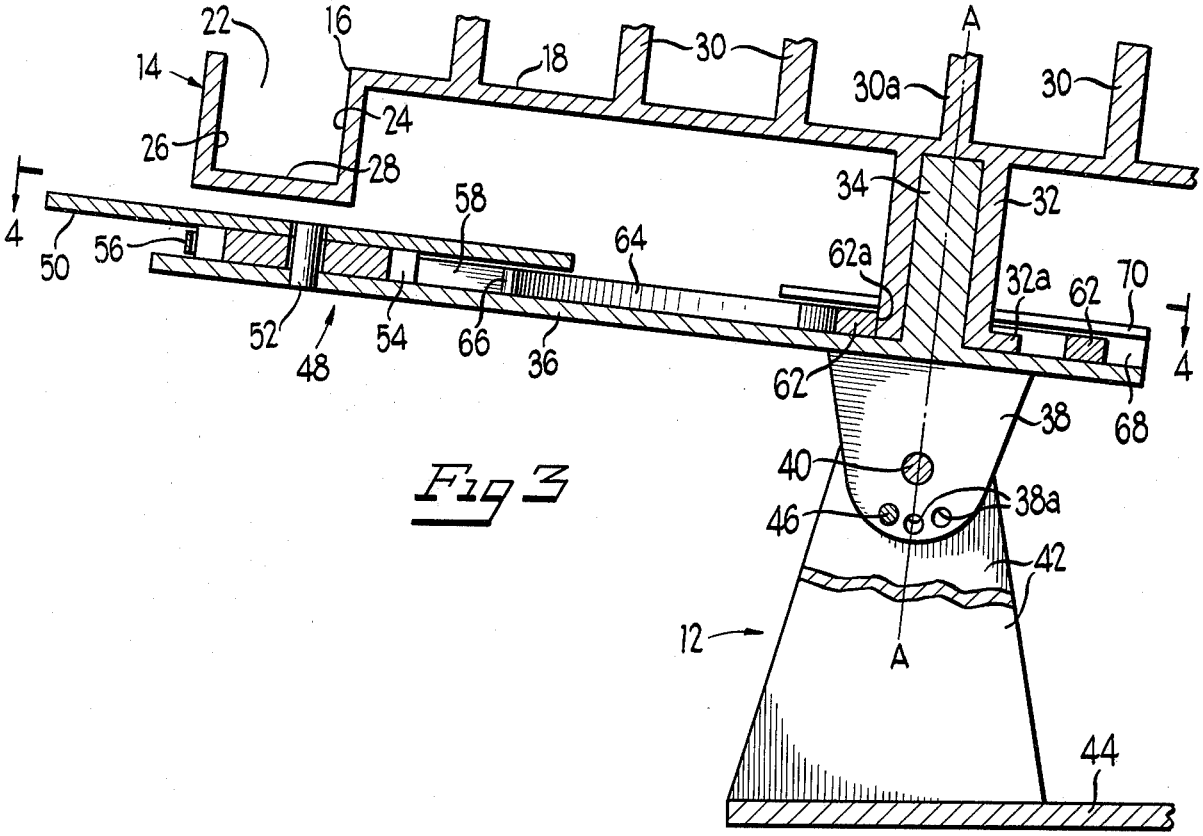
FIG. 3 is a fragmentary, vertical, cross-sectional view taken substantially along lines 3—3 of FIG. 2.

The body includes an annular trough 22 around the outer periphery of the central platform 16 and the trough includes an inner depending, skirt or sidewall 24 projecting downwardly from the outer edge of the rolling surface 18 around the periphery and an outer trough sidewall 26 spaced outwardly concentric thereof and integrally joined with an annular bottom wall 28 (as best shown in FIG. 3). The circular, outer trough wall 26 provides a convenient hand rim for manual rotation of the body 14 so that the circular platform 16 can move in either direction around the upstanding inclined axis A—A to keep the ball from rolling off an edge into the trough.

Figure 2:
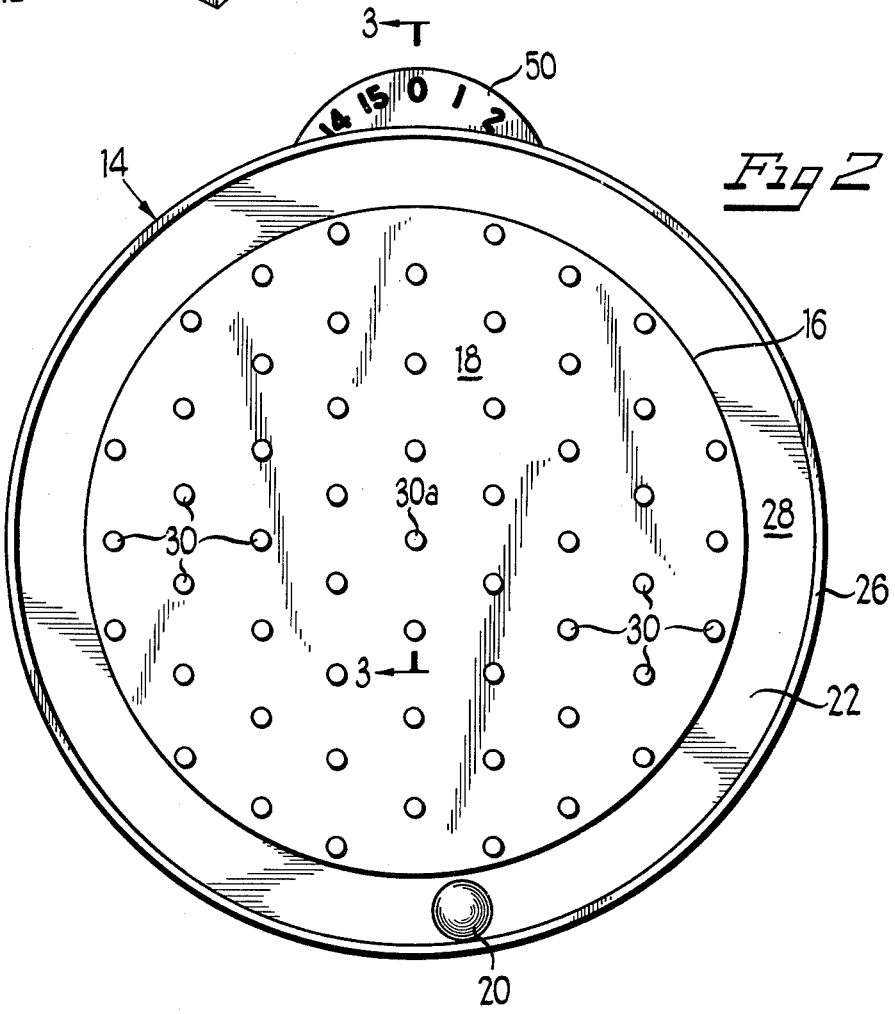
FIG. 2 is a top plan view of the toy of FIG. 1.

In accordance with the present invention, a plurality of upstanding pins 30 are integrally formed on the body structure 14 to project upwardly of the planar, circular rolling surface 18 at right angles and these pins provide a maze-like formation or obstacle course through which the rolling ball 20 passes. As illustrated in FIG. 2, the pins 30 are positioned in a plurality of spaced apart concentric circles of increasing radii around a centrally disposed pin 30*a* coaxially aligned with the inclined upstanding axis A—A.

In general, each pin is spaced apart from adjacent pins in any direction by a distance greater than the diameter of the rolling ball 20 which can freely pass therebetween. The pins in one concentric circle are spaced in a staggered relation between the pins of a next adjacent circle where possible to provide a widely distributed pin pattern as shown. It should be noted that the pin spacing in some of the outermost concentric rings is considerably greater than in the interior rings close to the central axis pin 30*a* and accordingly, when the ball 20 is in the vicinity of the outer rings it is likely to roll off the peripheral edge of the circular surface 18 into the trough 22 unless a pin is obstructing the path of the ball by timely manipulation of the cylindrical body 14.

In playing the game, the ball 20 is first released from an upper level or edge of the platform 16 at the position as shown in dotted lines in FIG. 1. Because of the slope of the surface 18, the ball begins to roll downwardly toward a lower edge portion of the platform structure 16. As this occurs, a player manually rotates the body 14 in either direction by grasping the outer trough wall 26. When rotating the structure, the array of pins 30 are moved for contact with a downwardly facing surface of the rolling ball to retain or impede the downward progress of the ball as long as possible. It is an object of the game to retain the ball on the circular surface 18 while as many complete revolutions of the platform 16 as possible are accomplished.

The body structure 14 is supported on the base structure 12 by a downwardly depending, sleeve 32 integrally formed on the underside of the platform 16 in coaxial alignment with the axis A—A. The sleeve is journaled on an upstanding axle pin 34 integrally formed on a base or leg 36 inclined upwardly and extending in a radial direction outwardly with respect to the inclined axis of rotation A—A. A supporting integral lug 38 depends downwardly from the underside of the leg 36 and this lug is mounted for rotation on a horizontal axle pin 40 extended transversely between the upper end portions of a pair of spaced apart upstanding support brackets 42 integrally formed on the upper surface of a rectangular shaped base 44 of the base structure 12.

In order to provide selective adjustment of inclination of the axis of rotation A—A, and consequently the angle of slope of the circular platform surface 18, the lug 38 is provided with a plurality of spaced apart apertures 38*a* positioned on a circular path concentric of the axle pin 40. A lock pin 46 is inserted into a selected one of the apertures 38*a* and an outer end portion(s) of the lock pin is secured in an aligned aperture(s) provided in one or both of the upstanding base brackets 42. Depending upon which one of the apertures 38*a* the lock pin 46 is inserted into, the angle of inclination of the platform surface 18 may be selected and thus, the difficulty of retaining the ball 20 on the surface for long periods of time may be increased with an increased slope angle or decreased with a shallow angle as desired. For example, when the angle of inclination or slope of the ball supporting surface 18 is relatively steep, more skill is needed in rapidly rotating of the maxe of pins 30 to engage and retain the ball 20 on the platform surface 18. When the angle of slope or inclination is relatively shallow, less skill is needed. Thus, the toy 10 may be utilized by players having a wide range of motor skills or manual dexterity and mental concentration.

Figure 4:
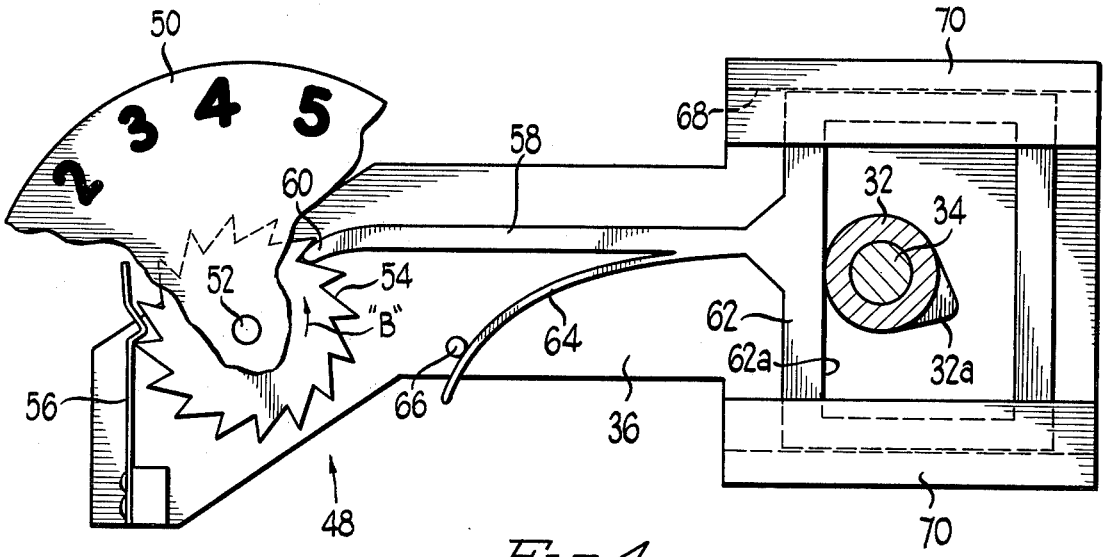
FIG. 4 is a fragmentary cross-sectional view taken substantially along lines 4—4 of FIG. 3.

In order to reflect and count the number of complete revolutions of the body structure 14 that is accomplished by a player, the toy 10 includes a digital reading counting mechanism 48 (FIGS. 3 and 4). The counter includes a circular indicating disk 50 having numbers spaced around the periphery as illustrated, with the number "0" indicated as a starting figure when the ball is released. The disk 50 is mounted for rotation on a short pin 52 integrally formed adjacent an outer end portion of the radial base leg 36 and a toothed rachet wheel 54 is mounted on the pin and connected to drive the disk 50 in a counterclockwise direction as indicated by the arrow "B" regardless of whether the body structure 14 is manipulated to rotate in a clockwise or a counterclockwise direction. An indexing detent spring 56 is provided to engage the teeth of the rachet wheel 54 and retain the disk 50 in each indexed position with one of the indicia thereon retained in a centered or indicating position until a complete revolution of the body structure 14 has taken place.

When a complete revolution is achieved, the indicating disk 50 is rotated in a counterclockwise direction to move the next larger number into an indicating postion on a line extending radially outward of the central pin 30*a* and coincident with the cross-section line 3—3 in FIG. 2.

Incremental rotation of the rachet wheel 54 to display the ever increasing numbers on the indicator wheel 50 is accomplished by reciprocating movement of a pawl 58 having a curved outer end portion 60 directly engaging the teeth of the rachet wheel 54. The pawl is integrally formed to extend radially outwardly of a box-like cam-follower structure 62 having a large rectangular opening through which the sleeve 32 and the supporting axle pin 34 extend as shown in FIG. 4. The sleeve 32 is formed with a radial cam lug 32*a* extending outwardly thereof and this cam lug is engageable with a surface 62*a* on one side of the rectangular opening of the box-like structure 62 to bias the pawl 58 outwardly each time the cam lobe is rotated to move between the axle pin 34 and the adjacent cam-follower surface 62*a* during rotation of the body structure 14.

The box-like cam-follower structure 62 is continuously biased inwardly toward the pin 34 by means of an integrally formed, spring-like finger 64 having a relatively thin, free outer end portion which is continuously engaged against a pin 66 provided on the leg 36 as shown in FIGS. 3 and 4. The box-like cam-follower is guided for linear, reciprocal sliding movement within a keyway or guideway 68 formed by a pair of guide ribs 70 on opposite sides of the axle pin 34 generally parallel of the pawl 58. Engagement between the opposite edge surfaces of the box-like cam-follower 62 and the surfaces of the guide-way 68 formed by the ribs 70 insures that linear reciprocal movement of the pawl 58 is maintained in a generally radial direction toward and away from the rachet wheel 54.

From the foregoing it will be seen that rotation of the cam lug 32*a* into and out of contact with the internal surface 62*a* of the box-like cam-follower 62 causes the rachet wheel 54 and hence, the indicia displaying disk 50 to rotate by a selected incremental amount regardless of whether the cam lug 32*a* is rotated in a clockwise or counter-clockwise direction. Accordingly, during play, a complete revolution of the body structure 14 in either direction will increase the number displayed in the indicating position to provide a count of the number of complete revolutions of the body structure 14 relative to the base 12 that have been completed.

The manipulation toy 10 as described and shown is fun to play and required both mental concentration as well as manual dexterity. The toy can be used for competitive games and the easiness or degree of difficulty may be selectively adjusted as desired by changing the inclination of the axis of rotation A—A. The toy may be constructed of molded plastic material in a mass production process, and is desirable to a wide range of population to provide long hours of enjoyment for young and old alike.

Although the present invention has been described with reference to a single illustrated embodiment thereof, it should be understood that numerous other modifications and embodiments can be devised by those skilled in the art that will fall within the spirits and scope of the principles of this invention.

What is claimed as new and desired to be secured by Letters Patent of the United States is:

1. A manipulation toy comprising:

a platform having a sloping upper surface for supporting a rolling ball placed thereon at an upper level for rolling movement toward a lower level, means for supporting said platform for rotation about an inclined axis extending upwardly of a central portion thereon, means for counting revolutions of said platform around said axis from time said ball is released at said upper level until it reaches said lower level, and a plurality of upstanding pins mounted at spaced apart positions around said axis on said upper surface for engagement with said rolling ball as said platform is rotated to impede the progress thereof from said upper level toward said lower level.

2. The manipulation toy of claim 1 including a trough around the periphery of said platform at a level lower than said surface for receiving and containing a ball rolling off an edge of said surface.

3. The manipulation toy of claim 1 wherein said supporting means is selectively adjustable between several different angles of inclination for said axis of rotation.

4. The manipulation toy of claim 1 wherein said upper surface of said platform is planar and said pins extend upwardly thereof perpendicular thereto.

5. The manipulation toy of claim 1 including a rolling ball and; wherein said pins are positioned on said platform with a spacing interval between adjacent pins greater than the diameter of said ball.

6. The manipulation toy of claim 5 wherein said pins are positioned in concentric circular patterns of increasing radii around said axis of rotation.

7. The manipulation toy of claim 6 wherein the pins in one circular pattern are staggered between the pins in a next adjacent circular pattern.

8. The manipulation toy of claim 1 wherein said counting means is mounted on said supporting means and is responsive to relative rotation of said platform around said axis to indicate a number of complete revoltuions of said platform.

9. The manipulation toy of claim 1 wherein said counting means includes a disk having indicia thereon for display of the number of revolutions of said platform around said axis.

10. The manipulation toy of claim 9 wherein said disk is manually resettable to indicate a starting indicia.

11. The manipulation toy of claim 9 wherein said counting means includes a rachet wheel driving said disk and pawl means activated by rotation of said platform for rotating said wheel to reindex said disk each revoltuion of said platform.

* * * * *